United States Patent [19]

Miles

[11] 4,085,336

[45] Apr. 18, 1978

[54] LIQUID FLOW ACTIVATED SWITCH

[75] Inventor: Charles M. Miles, Independence, Mo.

[73] Assignee: Paul F. Walters, Kansas City, Mo.

[21] Appl. No.: 712,929

[22] Filed: Aug. 9, 1976

[51] Int. Cl.[2] ..... H01H 35/40

[52] U.S. Cl. ..... 307/118; 200/81.9 M; 219/496

[58] Field of Search ..... 200/81.4, 81.9 M; 307/118; 219/308, 309, 332, 496

[56] References Cited

U.S. PATENT DOCUMENTS

| | | | |
|---|---|---|---|
| 2,307,304 | 1/1943 | Rudd | 200/81.9 M |
| 2,850,610 | 9/1958 | Kasuga | 219/332 |
| 3,549,276 | 12/1970 | Walding, Jr. | 200/81.9 M |

FOREIGN PATENT DOCUMENTS

| | | | |
|---|---|---|---|
| 1,455,275 | 10/1966 | France | 200/81.9 M |

*Primary Examiner*—Gerald P. Tolin

*Attorney, Agent, or Firm*—Fishburn, Gold & Litman

[57] ABSTRACT

A liquid flow activated switch is operative to effect completion of an electrical circuit and energizing of an electrical power using device, such as an electric water heater, upon commencing of liquid flow through a liquid inlet of a housing having walls defining a chamber therein. A switch member is pivotally mounted in the chamber and has a first portion positioned between the liquid inlet and a liquid outlet so that liquid entering the chamber impinges upon the first portion of the switch member to move a second portion of the switch member and a magnet thereon to a second position energizing magnetically operated components mounted on the housing and electrically connected to the electrical circuit.

6 Claims, 5 Drawing Figures

Fig. 1.
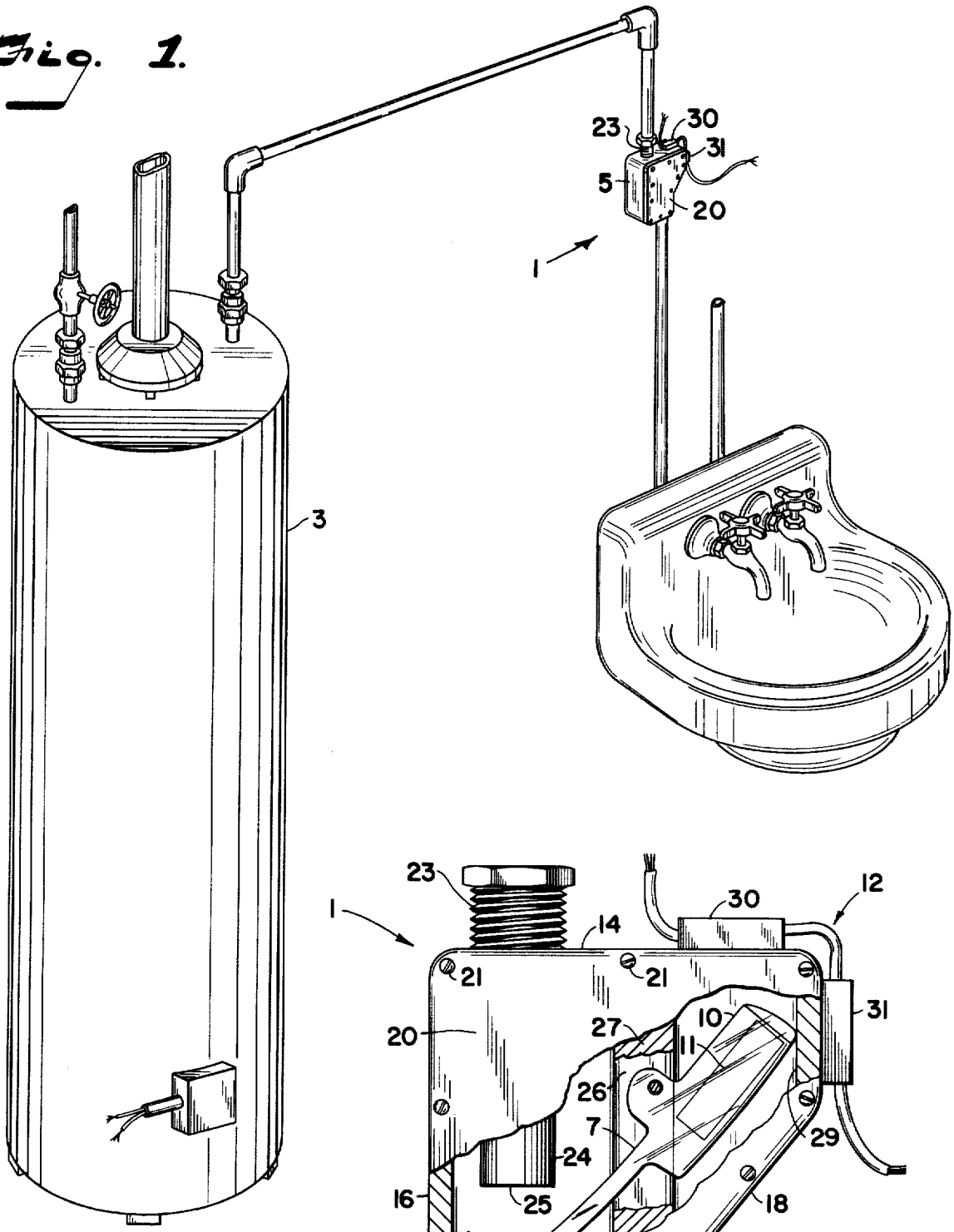
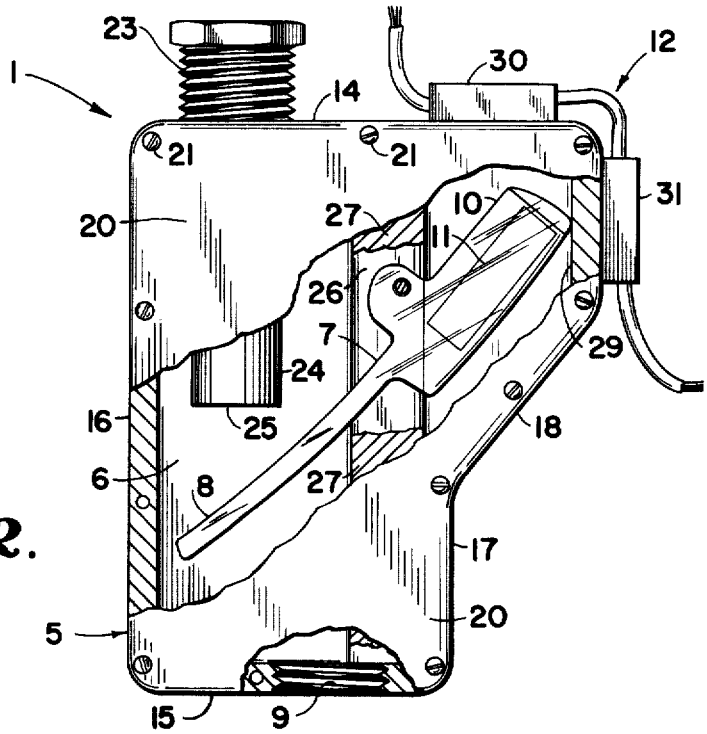
Fig. 2.

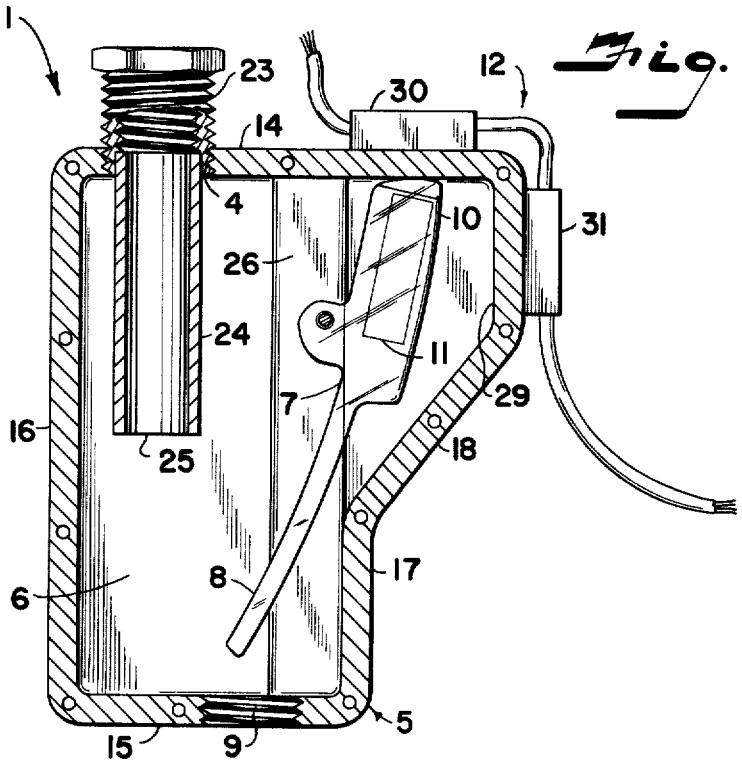
Fig. 4.
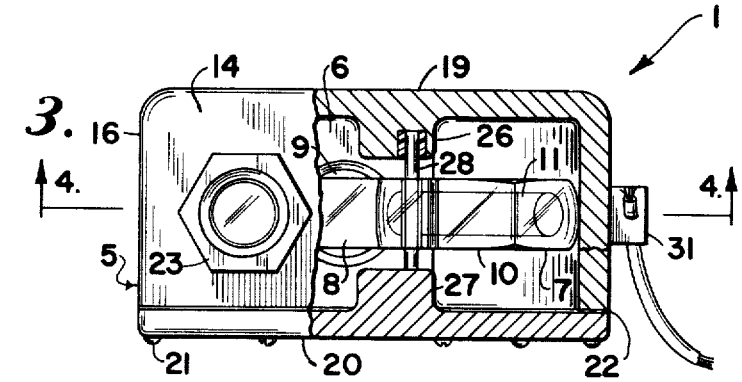
Fig. 3.
Fig. 5.
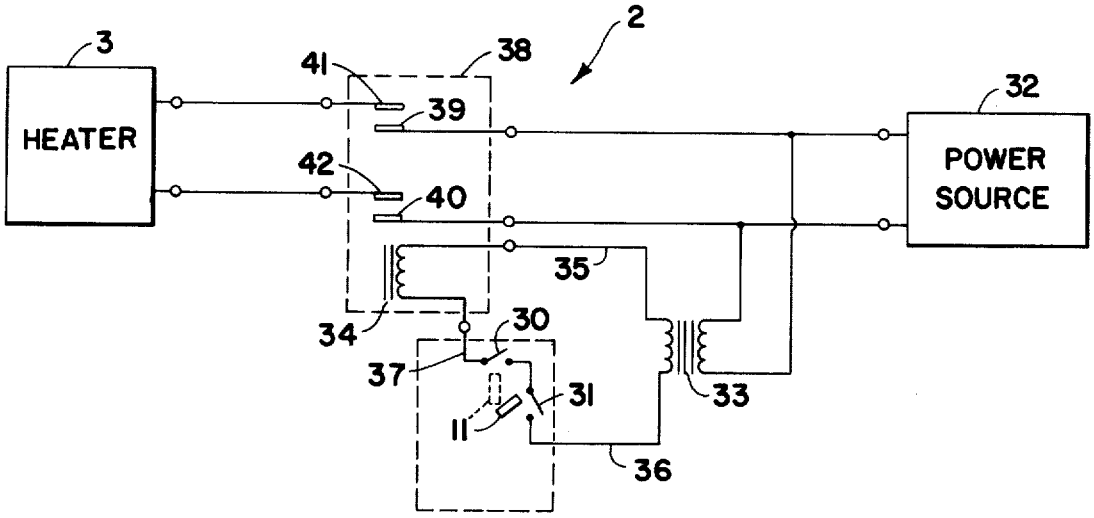

LIQUID FLOW ACTIVATED SWITCH

The present invention relates to flow sensing devices and more particularly to a liquid flow activated switch operative to effect completion of an electrical circuit and energizing of an electrical power using device upon commencing of liquid flow through a liquid inlet of a housing having walls defining a chamber therein.

The principal objects of the present invention are: to provide a liquid flow activated switch operative to effect completion of an electrical circuit and energizing of an electrical power using device, such as a water heater, upon commencing of liquid flow through a liquid inlet and into a chamber within a housing; to provide such a liquid flow activated switch having an element pivotally mounted relative to the chamber and positioned with a first portion thereof between the liquid inlet and a liquid outlet so that liquid entering the chamber impinges on the first portion of said element to move a second portion of said element and a magnet thereon to a second position energizing magnetically operated means mounted on the housing and electrically connected to the electrical circuit; to provide such a liquid flow activated switch wherein the switch element is eccentrically mounted so that the switch element returns to the first position by gravity when liquid flow through the liquid inlet ceases; to provide such a liquid flow activated switch wherein the liquid outlet is offset laterally from the liquid inlet whereby liquid must flow laterally to flow outwardly through the outlet after impinging on the first portion of the switch element; to provide such a liquid flow activated switch which is responsive to minimum flow of liquid impinging on the first portion of the switch element; to provide such a liquid flow activated switch wherein the magnetically operated components of the electrical circuit are operative to complete the electrical circuit when flow commences and to break the electrical circuit when flow ceases; and to provide such a liquid flow activated switch which is economical to manufacture, durable in construction, formed of non-corrosive materials, positive in operation, and particularly well adapted for the proposed use.

Other objects and advantages of this invention will become apparent from the following description taken in connection with the accompanying drawings wherein are set forth by way of illustration and example certain embodiments of this invention.

The drawings constitute a part of the specification and include an exemplary embodiment of the present invention and illustrate various objects and features of the liquid flow activated switch.

FIG. 1 is a perspective view of a liquid flow activated switch embodying features of the present invention and shown in a typical installation.

FIG. 2 is an enlarged front elevational view of the liquid flow activated switch with portions broken away to show a switch member in a first position.

FIG. 3 is an enlarged top plan view with portions broken away to better illustrate component parts of the liquid flow activated switch.

FIG. 4 is an enlarged transverse sectional view taken on line 4—4 of FIG. 3 and showing the switch member in a second position.

FIG. 5 is an electrical wiring diagram with components of an electrical circuit diagramatically shown.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in detail to the drawings:

In the disclosed embodiment of the present invention, the reference numeral 1 designates generally a liquid flow activated switch which is operative to effect completion of an electrical circuit 2 and energizing of an electrical power using device 3, such as an electrical water heater, upon commencing of liquid flow through a liquid inlet 4 of a housing 5 having walls defining a chamber 6 therein. The liquid flow activated switch 1 includes a switch member or element 7 pivotally mounted in the chamber 6 and having a first portion 8 positioned between the liquid inlet 4 and a liquid outlet 9 so that liquid entering the chamber 6 impinges upon the first portion 8 of the switch member of element 7 to move a second portion 10 of the switch member or element 7 and a magnet 11 thereon to a second position energizing magnetically operated means 12 mounted on the housing 5 and electrically connected to the electrical circuit 2.

The housing 5 is sized and shaped for flow of liquid therethrough and movement of the switch member or element 7 between the first or at rest position and the second or circuit completion position. The illustrated housing 5 has a top wall 14 with the liquid inlet 4 therein and a bottom wall 15 with the liquid outlet 9 therein. Opposite side or end walls 16 and 17 extend between and are preferably integral with the top and bottom walls 14 and 15. One of the end walls, for example end wall 17, has an offset portion 18 therein positioned so that the second portion 10 of the switch member 7 is adjacent thereto when in the rest position. A rear wall 19 is preferably integral with the top and bottom walls 14 and 15 and the end walls 16 and 17 thereby defining a substantially rigid structure.

A front wall 20 is suitably mounted on free edges of the top and bottom walls 14 and 15 and the end walls 6 and 17, as by a plurality of spaced screws 21. A seal member 22 is positioned between the front wall 20 and the free edges of the top and bottom walls 14 and 15 and the end walls 16 and 17 thereby defining a liquid-tight housing.

The top and bottom walls 14 and 15 have threaded apertures therein defining the liquid inlet 4 and the liquid outlet 9 respectively. The liquid inlet 4 includes an internally and externally threaded nipple 23 received in the aperture in the top wall 14. A tubular member 24 is suitably mounted on and depends from the nipple 23, as by welding or being press-fitted in the lower end portion thereof. The tubular member 24 has a lower end 25 positioned in the chamber 6 and above the first portion 8 of the switch member 7. The liquid inlet 4 and the liquid outlet 9 are offset laterally one from the other whereby liquid must flow laterally to flow outwardly through the liquid outlet 9 after impinging on the first portion 8 of the switch member 7.

The switch member 7 is positioned between the front and rear walls 19 and 20 and pivotally mounted thereon. The illustrated switch member is an elongated member having an intermediate portion thereof pivotally mounted on enlarged portions or ribs 26 and 27 positioned in opposed relation and extending inwardly from the rear wall 19 and the front wall 20 respectively. The enlarged portions or ribs 26 and 27 support respective opposite end portions of a pivot pin 28 therein. Opposite ends of the pivot pin 28 are preferably received in suitable non-corrosive bearings, such as sealed bearings.

The first portion 8 of the switch member 7 is generally flat and thin relative to the second portion 10 which is enlarged to receive therein the magnet 11. The weight of the magnet 11 and the second portion 10 is greater than the weight of the first portion 8 whereby the switch member 7 moves to the first or rest position with the free end of the second portion 10 in engagement with and supported on an upper portion 29 of the end wall 19 thereby positioning the magnet 11 adjacent the upper portion 29, for a purpose later described, as best seen in FIG. 2. The first portion 8 is positioned below the lower end 25 of the tubular member 24 and the switch member is balanced in a manner such that even a minimum of flow impinging thereon is sufficient to move the switch member 7 to the second position, as best shown in FIG. 4.

FIG. 9 illustrates the electrical circuit 2 having the magnetically operated means 12 mounted on the housing 5 and positioned such that movement of the switch member 7 to the second position effects completion of the electrical circuit 2. The magnetically operated means 12 includes a normally-open magnetic switch 30 mounted on the top wall 14 and positioned to be closed when the magnet 11 and the switch member 7 are in the second position thereby completing the electrical circuit 2. The magnetically operated means 12 also includes a normally-closed magnetic switch 31 mounted on an upper portion 29 of the end wall 17 and positioned to be opened when the magnet 11 and switch member 7 are in the first position thereby breaking the electrical circuit 2.

The electrical circuit 2 includes an electrical power source 32, such as 220-volts or 110-volts. A stepdown or reduction transformer 33 is electrically connected to the power source 32 and is operative to provide reduced voltage output, such as 15-volts. The transformer 33 is electrically connected to a coil relay 34 by a first conductor 35 and to the normally-closed magnetic switch 31 by a second conductor 36. The coil relay 34 is electrically connected to the normally-open magnetic switch 30 by a suitable electrical conductor 37 and the coil relay 34 is energized by the magnet 11 being positioned in the second position adjacent the top wall 14 and adjacent the normally-open magnetic switch 30.

The electrical circuit 2 includes switch means 38 having first contacts 39 and 40 electrically connected to the electrical power source 32 and having second contacts 41 and 42 electrically connected to the electrical power using device 3. The second contacts 41 and 42 are movable into circuit making contact with the first contacts 39 and 40 respectively upon energizing of the coil relay 34 by movement of the switch member 7 and the magnet 11 thereon to the second position thereby energizing the power using device 3.

When the switch member 7 and magnet 11 are in the first or at rest position, the normally-open switch 30 is open and the normally-closed switch 31 is opened by the magnet 11 whereby the electrical circuit 2 is inoperative. When the switch member 7 and the magnet 11 are in the second position in response to liquid flow through the liquid inlet 4, the normally-open magnetic switch 30 is closed by the magnet 11 and the normally-closed switch 31 is closed whereby the electrical circuit 2 is completed and operative to energize the transformer 33 and the coil relay 34 thereby effecting movement of the second contacts 41 and 42 into circuit making contact with the first contacts 39 and 40 and energizing the electrical power using device 3.

After liquid flows through the liquid inlet 4 and impinges on the first portion 8 of the switch member 7 thereby moving the switch member 7 from the first position to the second position, liquid is deflected toward the end wall 16 and toward the bottom wall 15. After the switch member 7 has moved to the second position, liquid must flow laterally to enter the outlet 9. The lower portion 9 of the end wall 17 is adjacent the outlet 9 so that there is a minimum of turbulance in the chamber 6.

It is to be understood that while I have illustrated and described one form of my invention it is not to be limited to the specific form or arrangement or parts herein described and shown.

What I claim and desire to secure by Letters Patent is:

1. A liquid flow activated switch comprising:

(a) a housing having walls defining a chamber therein;

(b) means on said housing defining a liquid inlet communicating with the chamber;

(c) means mounted on said housing in spaced relation to said liquid inlet defining a liquid outlet communicating with the chamber;

(d) a switch member pivotally mounted in the chamber and having a first portion and a second portion; said switch member first portion being positioned adjacent said liquid inlet whereby liquid entering the chamber through said liquid inlet impinges upon the same and pivots said switch member from a first to a second position;

(e) a magnet mounted on said switch member second portion and movable therewith;

(f) an electrical circuit having magnetically operated means on said housing and positioned such that movement of said switch member to the second position effects completion of said electrical circuit; and wherein (g) said magnetically operated means includes a normally-closed magnetic switch positioned to be opened when said magnet and switch member are in said first position thereby breaking said electrical circuit, and a normally-open magnetic switch positioned to be closed when said magnet and switch member are in said second position thereby completing said electrical circuit; said normally-closed switch and said normally-open switch being interconnected in series for reliable switching of said electrical circuit.

2. A liquid flow activated switch as set forth in claim 1 wherein said electrical circuit includes:

(a) a source of electrical power;

(b) transformer means electrically connected to the source of electrical power and to one of said normally-closed magnetic switch and said normally-open magnetic switch;

(c) coil relay means electrically connected to said transformer means and to the other of said normally-closed magnetic switch and said normally-open magnetic switch, said coil relay means being energized by said magnet being positioned in said second position; and (d) switch means having first contacts electrically connected to the source of electric power and second contacts adapted for electrical connection to an electrical power using device, said second contacts being movable into circuit making contact with said first contacts upon energizing said coil relay means by movement of said switch member and magnet to said second position thereby energizing the electrical power using device.

3. A liquid flow activated switch as set forth in claim 1 including:

(a) a tubular member having one end connected with said liquid inlet and a free end extending downwardly therefrom into said chamber adjacent said switch member first portion; and wherein (b) said switch member is pivotally mounted in said chamber at a pivot joint;and (c) said switch member first portion is generally downwardly inclined from said pivot joint, and is disposed at an acute angle to a central axis of the tubular member, whereby said liquid impinges upon the switch member first portion at an acute angle to alleviate flow restriction through the switch.

4. A liquid flow activated switch as set forth in claim 3 wherein:

(a) said tubular member free end is laterally offset from said liquid outlet, whereby liquid flow through said switch retains said switch member in the second position.

5. A liquid flow activated switch as set forth in claim 1 wherein:

(a) said normally-closed switch and said normally-open switch are each mounted on an outside surface of said housing for safe operation.

6. A liquid flow activated switch as set forth in claim 3 wherein:

(a) said switch member first portion includes opposing sides edges and a lateral dimension substantially co-extensive with the tubular member free end; said first portion side edges each being spaced apart from an associated interior surface of said housing walls whereby said liquid flows therebetween for gentle pivoting of said switch member and reliable switching.

* * * * *